United States Patent [19]

Okumura et al.

[11] Patent Number: 4,821,388

[45] Date of Patent: Apr. 18, 1989

[54] METHOD FOR PROCESSING A NUT SEAT ON A WHEEL

[75] Inventors: Tsunemasa Okumura, Aichi; Shunji Kobayashi, Okazaki, both of Japan

[73] Assignee: Topy Kogyo Kabushiki Kaisha, Tokyo, Japan

[21] Appl. No.: 184,800

[22] Filed: Apr. 22, 1988

[30] Foreign Application Priority Data

Apr. 24, 1987 [JP] Japan ..... 62-99993

[51] Int. Cl.[4] ..... B21H 1/02

[52] U.S. Cl. ..... 29/159.01; 72/126; 301/9 DN; 29/90.01

[58] Field of Search ..... 29/159.01, 159.03, 159.1, 29/90.01; 72/122, 123, 126, 120; 301/37 SS, 6 R, 9 CN, 54, 58, 69, 9 DN

[56] References Cited

U.S. PATENT DOCUMENTS 3,131,972 5/1964 Walton et al. ..... 301/9 DN 3,320,652 5/1967 Huber et al. ..... 29/90.01

FOREIGN PATENT DOCUMENTS 61-201902 12/1986 Japan .

*Primary Examiner*—P. W. Echols

*Assistant Examiner*—Kevin E. Jordan

*Attorney, Agent, or Firm*—Cushman, Darby & Cushman

[57] ABSTRACT

A method for processing a nut seat formed around a bolthole on a wheel including the steps of drilling the nut seat and the bolthole substantially simultaneously with a step drill and performing roller burnishing on at least edge portions of the nut seat wherein the roller is rolled on the nut seat in the circumferential direction of the nut while the roller is pressed onto the nut seat. By roller burnishing, at least the edge portions of the nut seat are finished to a specular grade. The strength of the nut seat itself can be increased by the roller burnishing, thereby decreasing the required thickness of a light alloy wheel and the total weight of the wheel. In addition, the manhours for processing the wheel can be reduced.

10 Claims, 4 Drawing Sheets

METHOD FOR PROCESSING A NUT SEAT ON A WHEEL

BACKGROUND OF THE INVENTION

1. Field of the Invention:

The present invention relates to a method for processing a nut seat on a wheel of a vehicle, and more particularly, to a processing method for increasing the strength of the nut seat portion.

2. Description of the Prior Art:

Generally, a vehicle wheel is fixed to an axle hub with stud bolts projecting from the hub. The wheel has a plurality of boltholes for the stud bolts and nut seats formed around the boltholes for nuts which engage the stud bolts. Typically, where the wheel is constructed from a light alloy such as an aluminium alloy and particularly where the wheel is large, the nut seat on the wheel is formed as a spherical surface. Since the nut is pressed against the nut seat portion around the bolthole and since the shape of the inner surface of the nut seat radically changes at the edge portions, a local concentration of stress at the edge of the nut seat can occur. If there are flaws in the nut seat, as discussed below, cracks can grow from the flaws as the nut seat portion is repeatedly stressed and a fatigue breakage can occur in the nut seat. Accordingly, the existence of such flaws can greatly decrease the fatigue strength and life span of the wheel.

The conventional method for processing a nut seat on a wheel includes the following steps.

First, a bolthole and a nut seat around the bolthole are drilled by a step drill. Then, the nut seat is finished to the required spherical shaped surface by cutting or coining. The coining is a processing method wherein an unrotatable tool is pressed onto the nut seat and the surface of the nut seat is compressed to a required shape by the compression force of the tool. Finally, the edge portions of the nut seats are chamfered by hand finishing.

With such a method, particularly where cutting is employed, minute flaws from the cutting process inevitably remain. The minute flaws cause the fatigue strength of the nut seat portion to decrease. In addition, even where coining is employed the flaws from the drilling process are merely compressed and, therefore, the minute flaws still remain although their depth may be decreased. Moreover, since the flaws from drilling remain even after coining, the surface of the nut seat finished by coining can be relatively rough. In a nut seat having a rough surface, cracks are more likely to grow than in a smooth surfaced nut seat.

A further consideration is that since the coining and chamfering steps are performed in a different machine and with a difference process than the drilling step, the wheel must be reset after drilling. Furthermore, it is difficult to obtain a precise chamfer dimension and the chamfering itself requires a high level of skill. This method, therefore, requires a great deal of manhours and skill.

As is apparent from the foregoing the conventional processing method is not only time consuming but the resulting nut seat portion is weaker than the remaining portions of the wheel. In order to overcome this problem, heretofore the requisite strength of the nut seat portions of the wheel has been ensured by increasing the thickness of the entire wheel. However, increasing the thickness disadvantageously increases the weight of the wheel.

The increase of the thickness of the wheel also has the following problem. Where a steel wheel with a small thickness is replaced with a light-alloy wheel having a relatively large thickness, the stud bolts must often be replaced with longer ones to correspond to the increase in the wheel thickness. This increases the time and cost for changing the wheel.

SUMMARY OF THE INVENTION

An object of the present invention is to provide a method for processing a nut seat which will increase the strength of the nut seat itself, thus eliminating the need to increase the thickness of the wheel and the problems associated with an increase in wheel thickness.

Another object of the present invention is to provide a method for processing a nut seat that enables the easy finishing of the nut seat to a specular grade, thereby greatly improving the surface roughness of the nut seat.

A further object of the present invention is to provide a method for processing a nut seat enabling finishing of the edge portions of the nut seat without requiring a hand finishing process and enabling finishing of the nut seat with the drilling machine, after drilling, thereby greatly reducing the manhours for the process.

To accomplish the above objects, the method for processing a nut seat on a wheel according to the present invention comprises the steps of drilling the nut seat and a bolthole on the wheel substantially simultaneously with a step drill and performing a roller burnishing on at least the edge portions of the nut seat. The roller burnishing is a process wherein at least one roller is rolled on the nut seat in a direction circumferentially of the nut seat while the roller is pressed onto the nut seat. At least the edge portions of the nut seat are finished to a specular grade by the roller burnishing.

With this method, the roller burnishing may be performed substantially simultaneously on the entire seat surface and the edge portions of the nut seat, or may be performed only on the edge portions of the nut seat.

In accordance with the method of the present invention, at least the edge portions of the nut seat drilled by the step drill are burnished by at least one roller which is pressed onto the nut seat and rolled on the nut seat in the circumferential direction thereof. The surface of the nut seat is compressed by the pressing of the roller. Work hardening results from the compression and a residual compression stress is generated on the surface. This work hardening and residual compression stress increase the strength of the nut seat itself, particularly the strength of the edge portions thereof. Moreover, since the roller rolls in the circumferential direction of the nut seat while it is pressed onto the nut seat, the surface of the nut seat is compressed and tanned. At the same time the minute flaws that were generated from the drilling step are tanned by the roller and, as a result, the flaws disappear in a short period of time. Thus, the surface of the nut seat is finished to a specular grade and the surface roughness of the nut seat greatly decreases. This also greatly increases the strength of the nut seat.

The increase of the strength of the nut seat makes it unnecessary to increase the thickness of the wheel. Therefore, the increase of the weight of the wheel can be prevented and a steel wheel can be replaced with a light alloy wheel without changing the stud bolts.

In addition, where both of the edge portions and the seat surface of the nut seat are burnished by the roller, since the edge portions and the seat surface are finished substantially simultaneously, the processing can be simplified and the manhours required for the processing can be decreased. Moreover, the appearance of the wheel can be improved by finishing to a specular grade both the edge portions and the seat surface of the nut seat.

Since the conventional hand finishing for the edge portions of the nut seat is no longer necessary, the working of the wheel is easier and the manhours required for the process can be decreased. Furthermore, if the tool body holding the roller is attachable to the drill head of the drilling machine, the roller burnishing can be performed immediately after drilling without resetting the wheel. All that would be required is exchanging the step drill and the tool body for the roller burnishing. This can also greatly decrease the processing time.

BRIEF DESCRIPTION OF THE DRAWINGS

The above and other objects, features and advantages of the present invention will be become apparent and can be more readily appreciated from the following detailed description of the preferred exemplary embodiments of the invention, taken in conjunction with the accompanying drawings which are given by way of illustration only, and thus are not intended to limit the present invention, and in which.

DETAILED DESCRIPTION OF THE PREFERRED EMBODIMENTS

The preferred embodiments of the present invention will be described hereafter referring to the attached drawings.

Figure 1:
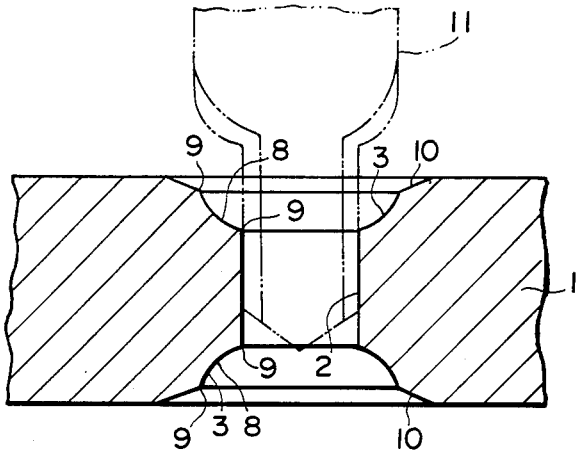
FIG. 1 is a sectional view of a nut seat portion and a bolthole portion of a wheel to be formed by a processing method according to an embodiment of the present invention.
Figure 2:
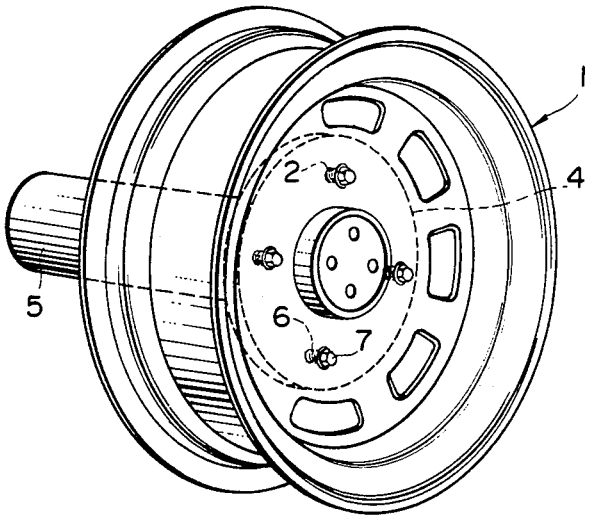
FIG. 2 is a perspective view of the wheel shown in FIG. 1.
Figure 3:
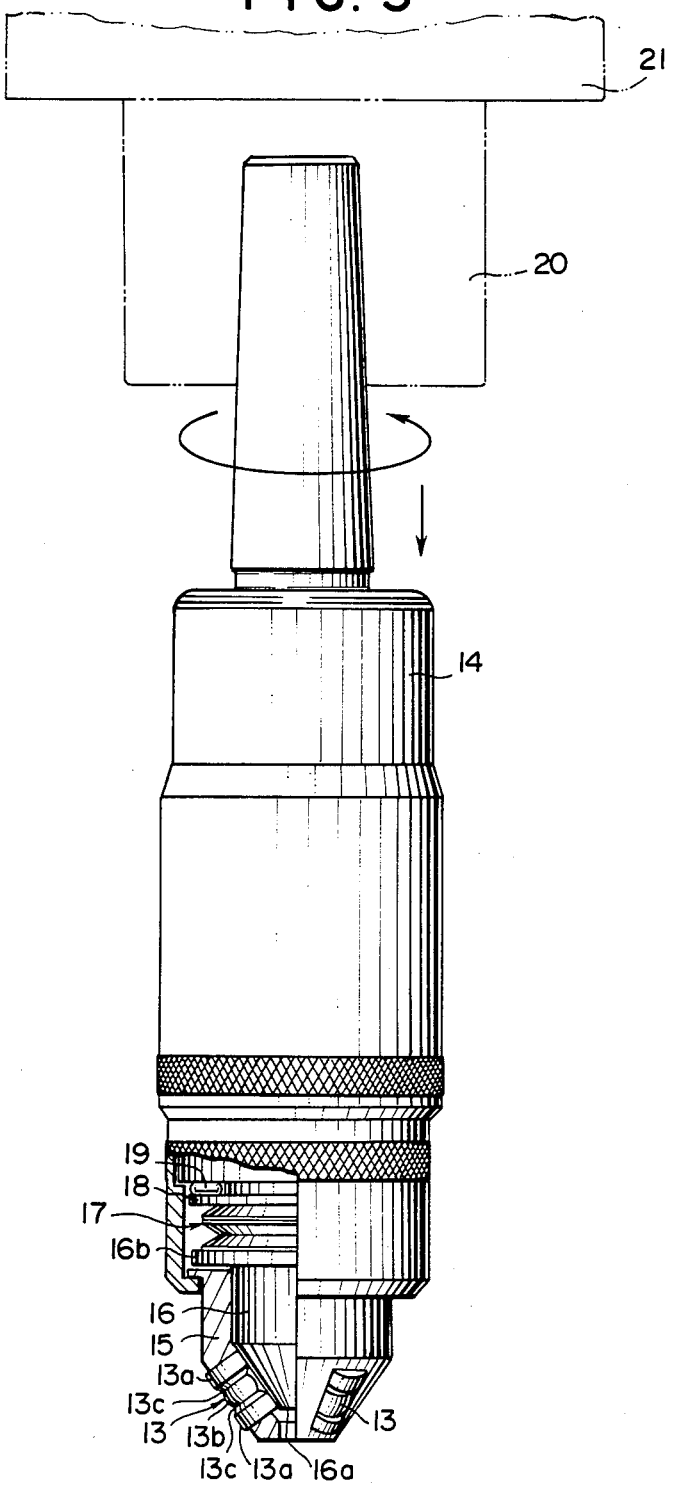
FIG. 3 is a side view, partially cut away, of a tool body holding rollers to be used for the method according to an embodiment of the present invention.

FIGS. 1–6 illustrate a wheel and a tool for carrying out a method according to an embodiment of the present invention. In FIGS. 1 and 2 a wheel 1 for a vehicle has a plurality of boltholes 2 defined through the wheel and nut seats 3 formed around the boltholes on the wheel. The wheel 1 is constructed from a light alloy, in the illustrated embodiment from an aluminium alloy. The wheel 1 is fixed to a hub 4 of an axle 5 via stud bolts 6 projecting from the hub which are passed through the boltholes 2. Nuts 7 engage the stud bolts and come into contact with the nut seats 3.

The bolthole 2 and the nut seat 3 are formed, for example, as shown in FIG. 1. In this example, the nut seats 3 are formed on both end portions of the bolthole 2. One of the nut seats 3 is for an inner nut of a double nut fixing system and the other is for an outer nut. In a case where there are only outer nuts, the nut seat 3 may be formed on one of the end portions of the bolthole 2.

The nut seat 3 has a spherical seat surface 8 and edge portions 9 at both ends of the seat surface. One of the edge portions 9 defines the seat surface 8 and the bolthole 2 and the other edge portion 9 defines the seat surface and a recessed portion 10 for run off of drilling.

The bolthole 2 is opened and the nut seat 3 is formed on the wheel 1 substantially simultaneously by drilling with a step drill 11. In this embodiment, the drilling is performed from the side of the front surface and the side of the back surface of the wheel 1, thereby forming the nut seats 3 on both of the end portions of the bolthole 2. The drilling process roughly forms the nut seats 3 including edge portions 9. Drilling with a step drill has been conventionally used, as noted above. Following the drilling step, as also noted above, many minute flaws remain all over the nut seat 3.

Figure 6:
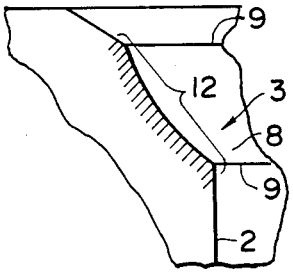
FIG. 6 is an enlarged sectional view of the nut seat portion showing the area for roller burnishing when the rollers shown in FIG. 3 are used.

After drilling, a roller burnishing is performed on at least the edge portions 9 of the nut seat 3. In this embodiment, the area 12 to be burnished includes the edge portions 9 and the entire seat surface 8, as shown in FIG. 6.

Roller burnishing is a process wherein at least one roller is rolled on the nut seat 3 in the circumferential direction of the nut seat while the roller is pressed onto the nut seat. In the embodiment shown in FIG. 3, a plurality of rollers 13 for the roller burnishing are provided. The rollers are rotatably held in a tool body 14 and are disposed in the circumferential direction of the nut seat 3. More particularly, the rollers 13 are rotatably held at the lower portion of a holder 15 whose upper portion is held in the tool body 14. The rollers 13 are urged downwardly by a cone portion **16*a* of a backup rod 16. The backup rod 16 and the holder 15 are rotatable relative to one another. An upper flange portion 16*b* of the backup rod 16 is urged downwardly by belleville springs 17 positioned on the flange portion. Thus the belleville springs 17 constitute an urging means. This urging means may be in the form of a coil spring rather than springs 17. A seat plate 18 is provided on the belleville springs 17 and the seat plate 18 is rotatably supported by a thrust bearing 19. In this embodiment, the tool body 14 is attachable to the drill head 20 of drilling machine 21** which is used for the drilling step.

Figure 5:
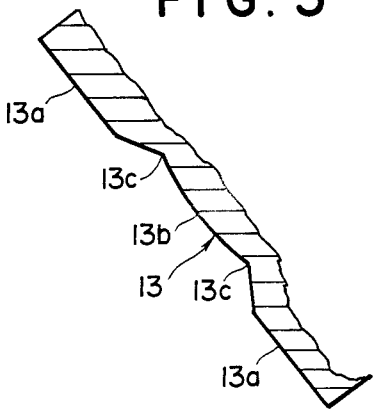
FIG. 5 is a schematic further enlarged partial sectional view of the roller shown in FIG. 3.

Roller 13 has cylindrical portions **13*a* at its end portions and the surfaces of the cylindrical portions come into contact with the cone portion 16*a* of the backup rod 16. The middle portion, between the cylindrical portions 13*a*, is formed as a spherical portion 13*b* having a shape identical with a required shape of the surface of the nut seat 3 and edge forming portions 13*c* have shapes identical with the required shapes of the edge portions 9 of the nut seat 3, as shown in FIG. 5**.

Figure 4:
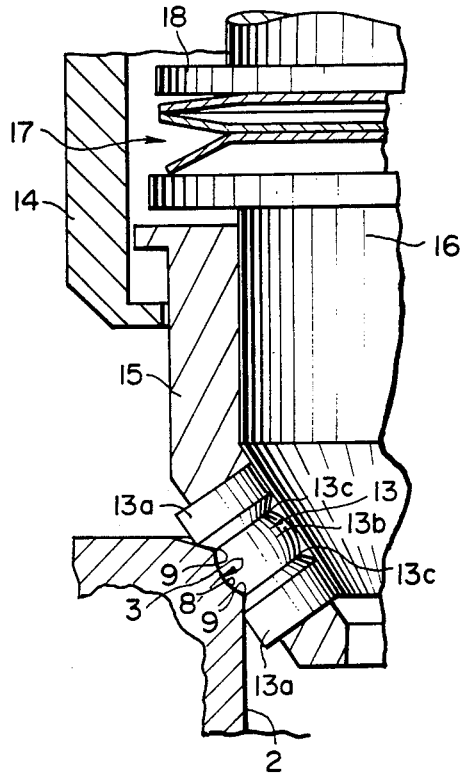
FIG. 4 is a schematic enlarged partial sectional view of the roller shown in FIG. 3 and the nut seat portion shown in FIG. 1.

After drilling with step drill 11, the step drill is exchanged for the tool body 14, and then roller burnishing is performed on the nut seat 3. The tool body 14 is moved forwards the nut seat and is rotated so that the rollers 13 are pressed onto the nut seat 3 and rolled on the nut seat in the circumferential direction of the nut seat. After the tool body 14 is moved towards the nut seat 3 to a point where the rollers 13 come into contact with the nut seat, the urging force of the belleville springs 17 press the rollers against the nut seat, as shown in FIG. 4.

Since the rollers 13 are pressed and rolled on the nut seat 3, the surface of the nut seat is formed and finished to a required shape identical with the shape of the surface of the roller. More particularly, the seat surface 8 having a spherical shape is formed by the spherical portion 13*b* of the roller 13 and the edge portions 9 are formed by the edge forming portions 13*c*. The surface of the nut seat 3 is compressed by the rollers 13, work hardening occurs and residual compression stress is generated on the surface, thereby increasing the strength of the entire nut seat 3, particularly the strength of edge portions 9 which have radically changed shapes. The work hardening increases the fatigue strength of the surface of the nut seat 3 and at the same time increases the strength of the wheel 1 as a whole. The residual compression stress prevents fatigue breakage from occuring on the nut seat 3 or on the portions near the nut seat by preventing the stress fluctuation range of the nut seat from entering an excessive tensile stress range. Therefore, the work hardening and the residual compression stress greatly increase the fatigue strength of the nut seat 3.

At the same time, since the rollers 13 are rolled on the nut seat 3 in the circumferential direction, the surface of the nut seat is pressed and tanned as are the minute flaws from drilling. As a result, the flaws disappear after a short period of time. Accordingly, the surface of the nut seat 3 including edge portions 9 is finished to a specular grade with substantially no flaws. This specular surface also increases the strength of the nut seat 3.

Because the strength of the nut seat 3 has been increased during processing, there is no need to increase the thickness of the wheel. Thus, the weight of the wheel can be decreased and the material required for the wheel can be reduced. Also when a steel wheel is replaced with a light alloy wheel, it is not necessary to change the stud bolts.

Since the edge portions 9 of the nut seat 3 can be finished to a specular grade by roller burnishing, alone, the conventional hand finishing for the edge portions is no longer necessary. Thus manhours and processing time required for the nut seat 3 are reduced. Furthermore, in the illustrated embodiment, since the tool body 14 can be attached to the drill head 20 of the drilling machine 21, the preparation for roller burnishing can be completed by simply exchanging the step drill 11 and the tool body 14. This also greatly reduces the processing time.

Figure 7:
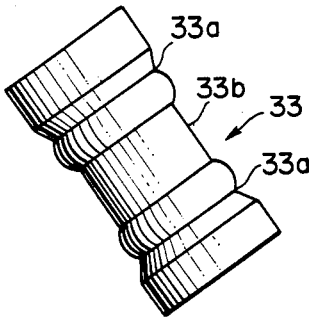
FIG. 7 is a side view of a roller to be used for roller burnishing that is performed only on edge portions of a nut seat according to another embodiment of the present invention.
Figure 8:
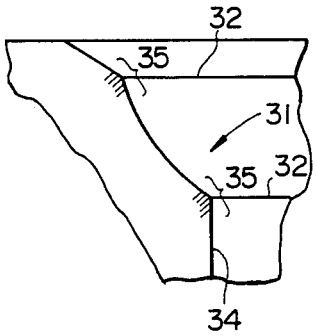
FIG. 8 is a sectional view of a nut seat portion showing the area for roller burnishing when the roller shown in FIG. 7 is used.

FIGS. 7 and 8 illustrate another embodiment according to the present invention.

In this embodiment, roller burnishing is performed only on edge portions 32 of a nut seat 31 formed around a bolthole 34. A roller 33 of this embodiment has a shape shown in FIG. 7. As can be seen, although the roller 33 has edge forming portions 33*a*, middle portion 33*b* is recessed.

With such a roller 33, only edge portions 32 and the portions near the edge portions, that is, areas 35 shown in FIG. 8, are burnished and the edge portions which may have weak portions are efficiently strengthened.

Although several preferred embodiments of the present invention have been described in detail, it will be appreciated by those skilled in the art that various modifications and alterations can be made to the particular embodiments shown without materially departing form the novel teachings and advantages of this invention. Accordingly, it is to be understood that all such modifications and alterations are included within the scope of the invention as defined by the following claims.

What is claimed is:

1. A method for processing a nut seat on a wheel, said nut seat being formed around a bolthole opened through said wheel, said method comprising the steps of:

drilling said nut seat and said bolthole on said wheel substantially simultaneously with a step drill; and performing a roller burnishing on at least the edge portions of said nut seat, including rolling at least one roller on said nut seat in a circumferential direction of said nut seat while said at least one roller is pressed onto said nut seat, said at least edge portions of said nut seat being finished to a specular grade by said roller burnishing.

2. The method of claim 1, wherein said roller burnishing is performed substantially simultaneously on the entire seat surface and both of said edge portions of said nut seat.

3. The method of claim 1, wherein said roller burnishing is performed solely on said edge portions of said nut seat.

4. The method of claim 1, wherein a seat surface of said nut seat is formed as a spherical surface.

5. The method of claim 1, wherein a plurality of rollers for said roller burnishing process are disposed in the circumferential direction of said nut seat.

6. The method of claim 1, wherein said at least one roller is held in a tool body and said tool body moves towards said nut seat and rotates so as that said at least one roller is pressed onto said nut seat and rolled on said nut seat in the circumferential direction of said nut seat.

7. The method of claim 6, wherein an urging means which urges said at least one roller towards said nut seat is provided in said tool body and said at least one roller is pressed onto said nut seat by the urging force of said urging means.

8. The method of claim 7, wherein said urging means comprises a spring and the urging force of said spring operates after said tool body moves towards said nut seat to a point where said at least one roller comes into contact with said nut seat.

9. The method of claim 6, wherein said tool body is attachable to a drill head of a drilling machine for said step of drilling, said step drill is exchanged for said tool body on said drilling machine after said step of drilling, and after said exchange said roller burnishing is performed using said tool body mounted to said drilling machine.

10. The method of claim 1, wherein said wheel is constructed from a light alloy.

* * * * *